US010597870B2

(12) United States Patent
Hedgcock

(10) Patent No.: US 10,597,870 B2
(45) Date of Patent: Mar. 24, 2020

(54) SYSTEM AND METHOD OF INTERLOCKING WALL PANELS

(71) Applicant: Adam Hedgcock, Brighton, MI (US)

(72) Inventor: Adam Hedgcock, Brighton, MI (US)

(73) Assignee: SUREPODS, LLC, Orlando, FL (US)

( * ) Notice: Subject to any disclaimer, the term of this patent is extended or adjusted under 35 U.S.C. 154(b) by 0 days.

(21) Appl. No.: 15/875,415

(22) Filed: Jan. 19, 2018

(65) Prior Publication Data

US 2018/0209144 A1 Jul. 26, 2018

Related U.S. Application Data

(60) Provisional application No. 62/448,143, filed on Jan. 19, 2017, provisional application No. 62/534,542, filed on Jul. 19, 2017.

(51) Int. Cl.

| | |
|---|---|
| ***E04B 2/70*** | (2006.01) |
| ***E04B 2/72*** | (2006.01) |
| ***E04B 2/56*** | (2006.01) |
| ***E04B 1/14*** | (2006.01) |
| ***E04C 2/38*** | (2006.01) |
| ***E04C 2/04*** | (2006.01) |
| *E04B 2/58* | (2006.01) |
| *E04H 1/12* | (2006.01) |
| *E04B 1/61* | (2006.01) |
| *E04B 1/348* | (2006.01) |

(52) U.S. Cl.

CPC ..... *E04B 2/721* (2013.01); *E04B 1/14* (2013.01); *E04B 2/56* (2013.01); *E04B 2/723* (2013.01); *E04C 2/043* (2013.01); *E04C 2/38* (2013.01); *E04B 1/34869* (2013.01); *E04B 1/61* (2013.01); *E04B 2/58* (2013.01); *E04B 2/70* (2013.01); *E04B 2103/02* (2013.01); *E04B 2103/04* (2013.01); *E04B 2103/06* (2013.01); *E04H 1/1216* (2013.01)

(58) Field of Classification Search

CPC .... E04B 2/721; E04B 2/723; E04B 2002/725; E04B 1/61; E04B 2/70; E04B 2/58; E04C 2/38

See application file for complete search history.

(56) References Cited

U.S. PATENT DOCUMENTS

| | | | | |
|---|---|---|---|---|
| 3,567,260 | A * | 3/1971 | Norris | E04B 1/6162 52/127.11 |
| 3,728,834 | A | 4/1973 | Dean | |
| 3,820,294 | A | 6/1974 | Parker | |
| 3,992,839 | A | 11/1976 | La Borde | |
| 4,381,632 | A | 5/1983 | Geitner | |
| 5,083,410 | A | 1/1992 | Watson | |

(Continued)

FOREIGN PATENT DOCUMENTS

| | | |
|---|---|---|
| EP | 0840829 | 5/1998 |

*Primary Examiner* — Adriana Figueroa

(74) *Attorney, Agent, or Firm* — Sheridan Ross PC

(57) ABSTRACT

An interconnectable wall panel system and method of forming and assembling the same are provided. A plurality of wall panels are provided that are interconnectable in a predetermined manner and arrangement, and wherein the wall panels comprise features for enhancing ease and accuracy of assembly. Wall panel members of the present disclosure are suitable for use in constructing modular building units, such as bathroom pods.

10 Claims, 7 Drawing Sheets

(56) References Cited

U.S. PATENT DOCUMENTS 5,222,902 A * 6/1993 Piersch ..... A63H 33/062 403/345
5,425,207 A * 6/1995 Shayman ..... E04B 7/22 52/269
5,561,960 A * 10/1996 Minnick ..... E04B 1/6137 403/386
5,711,128 A * 1/1998 Kordelin ..... E04B 1/6162 403/326
5,758,466 A 6/1998 Tucker
5,921,047 A * 7/1999 Walker ..... E04B 1/6141 52/282.2
6,205,725 B1 3/2001 Butler
6,235,367 B1 * 5/2001 Holmes ..... E04B 1/14 428/223
6,389,765 B1 5/2002 Hautala
6,588,166 B2 7/2003 Martensson et al.
6,647,562 B1 * 11/2003 Arout ..... E04H 4/0043 4/506
6,711,860 B2 * 3/2004 Fleishman ..... E04B 1/61 403/375
6,802,168 B1 * 10/2004 Minnick ..... E04C 2/384 248/224.51
6,892,498 B1 5/2005 Roman
7,818,939 B2 10/2010 Bearinger et al.
7,963,038 B2 * 6/2011 Schmitz ..... B64C 9/02 29/428
8,316,606 B2 * 11/2012 Siewert ..... E04F 13/10 52/483.1
8,516,766 B2 * 8/2013 Kuznetsov ..... E04F 13/18 52/588.1
8,800,234 B2 * 8/2014 Taillefer ..... B65D 88/08 220/682
9,382,703 B2 7/2016 Quinn et al.
9,670,669 B2 * 6/2017 Gosling ..... E04C 2/288
2004/0123548 A1 * 7/2004 Gimpel ..... E04B 1/6162 52/582.1
2006/0185283 A1 8/2006 Lee
2009/0064617 A1 * 3/2009 Montoya ..... E04B 1/161 52/309.12
2009/0100769 A1 * 4/2009 Barrett ..... A47K 4/00 52/35
2010/0050563 A1 * 3/2010 Kitchen ..... E04B 2/8635 52/745.1
2013/0180197 A1 * 7/2013 Gompper ..... E04F 13/0801 52/586.1
2015/0204072 A1 7/2015 Spear
2015/0354612 A1 * 12/2015 Koch ..... F16B 5/0052 403/376
2016/0032581 A1 * 2/2016 Sklar ..... A63H 33/084 52/220.8
2016/0138627 A1 * 5/2016 Bellido Jose ..... A47B 47/0066 428/100

* cited by examiner

SYSTEM AND METHOD OF INTERLOCKING WALL PANELS

This U.S. Non-Provisional patent application claims the benefit of priority from U.S. Provisional Patent Application Ser. No. 62/448,143, filed Jan. 19, 2017, and U.S. Provisional Patent Application Ser. No. 62/534,542, filed Jul. 19, 2017, the entire disclosures of which are hereby incorporated by reference in their entireties.

FIELD

The present disclosure relates to wall panels. More specifically, the present disclosure relates to interlocking wall panels that are useful in forming and constructing modular construction units.

BACKGROUND

Various methods and devices for joining wall panels and forming corners are known. Forming interior corners of walls that are intended to provide a living space generally require a flush, smooth, aesthetically pleasing surface. Constructing and joining drywall and gypsum panels generally comprises process steps of taping and mudding. Drying time is required in order to finish the wall(s). Existing methods and devices for constructing living spaces and forming corners require considerable amounts of time and labor and are subject to various inaccuracies and opportunities for error.

SUMMARY

Accordingly, there has been a long felt and unmet need to provide a system and method for joining wall panels in a quick, efficient, and accurate manner. Embodiments of the present disclosure provide such systems and methods as shown and described herein.

Various embodiments of the present disclosure provide methods and systems of interlocking wall panels units. In preferred embodiments, at least one wall panel is provided comprising at least one male interlock member, and at least one additional wall panel is provided comprising at least one female interlock member. The wall panels are adapted to interlock wherein the male interlock member is received by the female interlock member, thereby providing a system and method for fast and accurate assembly of wall panels. Wall panels of the present disclosure are contemplated for use with, but are not limited to, modular building and construction system such as modular bathroom units or "pods."

In certain embodiments, lightweight panelized structures are provided with interlocking members or features to increase the ease of assembling and accuracy of construction of a finished system. In some embodiments, interlocking members of the present disclosure are formed with the use of computer-controlled routers to machine precise interlocking features. Interlocking panels of the present disclosure include, but are not limited to gypsum panels and other material suitable for use in construction.

In certain embodiments of the present disclosure, methods and devices for forming or machining interlocking panels is provided. In further embodiments, methods of assembling interlocking panels to form a building structure or unit are provided. It is also contemplated that these methods may be combined. Accordingly, certain embodiments of the present disclosure provide a method including the steps of machining and assembling a plurality of interlocking wall panels.

In one embodiment, a system of preformed wall panels is provided comprising a plurality of pre-formed wall panels operable to be interconnected and to at least partially form or define a room or space. A first pre-formed wall panel comprises a first end and a second and a planar surface extending between the first end and the second end. The planar surface of the first pre-formed wall panel comprises a plurality of female receiving members comprising a predetermined distribution along the planar surface. A second pre-formed wall panel is provided that comprises a first end and a second end and a planar surface extending between the first end and the second end, the first end of the second pre-formed wall panel comprising a plurality of male extensions, the male extensions being sized and operable to be received within the plurality of female receiving members. The male extensions comprise substantially the same predetermined distribution as the female receiving members to facilitate and enable quick and easy alignment and assembly. A structure is at least partially formed by inserting the plurality of male extensions of the second pre-formed wall panel into the plurality of female receiving members in the first pre-formed wall panel to secure the first pre-formed wall panel and the second pre-formed wall panel to form at least one of an interior corner and an exterior corner. Systems of the present disclosure, including the aforementioned embodiment provide for an assembly method wherein the method is devoid of taping and mudding the first sheet of material and the second sheet of material. Devices and systems of the present disclosure provide for and enable assembly of a modular building structure or pod in a quick and efficient manner and dispense with the need for various skilled labor activities.

In some embodiments, methods of forming at least one wall panel are provided. In certain embodiments, methods comprise the steps of providing raw material for wall panels on a horizontal vacuum table with a milling machine that is moveable in at least two, and preferably three dimensions. A model or drawing is provided to the machine to enable a CNC machining process, and a cutting bit is operable to be controlled by the code from the drawing or model. The machined panel(s) is then removed from the milling machine and placed on a light gauge steel frame. The frame is then glued and/or screwed to a fiber rock panel to provide an assembled wall panel with appropriate dimensions and details.

In one embodiment, a method of forming a modular building unit is provided comprising the steps of: providing a plurality of pre-formed wall panels operable to be interconnected, wherein a first pre-formed wall panel comprises a first end and a second and a planar surface extending between the first end and the second end. The planar surface of the first pre-formed wall panel comprises a plurality of female receiving members comprising a predetermined distribution along the planar surface. A second pre-formed wall panel comprises a first end and a second end and a planar surface extending between the first end and the second end, the first end of the second pre-formed wall panel comprises a plurality of male extensions, the male extensions being sized and operable to be received within the plurality of female receiving members, and wherein the male extensions comprise substantially the same predetermined distribution as the female receiving members. The plurality of male extensions of the second pre-formed wall panel are inserted into the plurality of female receiving members in the first pre-formed wall panel to secure the first pre-formed wall panel and the second pre-formed wall panel to form at least one of an interior corner and an exterior corner. The method is preferably devoid of taping and mudding the first sheet of material and the second sheet of material.

In another embodiment, a method of forming a modular building unit is provided, the method comprising the steps of: providing a first sheet of material; providing a second sheet of material; forming a plurality of apertures in the first sheet of material, wherein the plurality of apertures are formed using a computer-numeric controlled process; forming a plurality of extensions on the second sheet of material, wherein the plurality of extensions are formed using a computer-numeric controlled process and wherein at least a portion of the plurality of extensions are provided co-planar with a surface of the second sheet of material; and inserting the plurality of extensions of the second sheet of material into the plurality of apertures in the first sheet of material to secure the first sheet of material and the second sheet of material and at least partially define an interior volume of a room.

In another embodiment, a method of forming a modular building unit is provided, the method comprising the steps of: providing a first sheet of material; forming the first sheet of material to a desired size by cutting a portion of the first sheet of material; providing a second sheet of material; forming the second sheet of material to a desired size by cutting a portion of the second sheet of material; forming a plurality of apertures in the first sheet of material; forming a plurality of extensions on the second sheet of material, wherein at least a portion of the plurality of extensions are provided co-planar with a surface of the second sheet of material; and inserting the plurality of extensions of the second sheet of material into the plurality of apertures in the first sheet of material to secure the first sheet of material and the second sheet of material and form a substantially perpendicular union of the first sheet of material and the second sheet of material that is operable to be provided as a corner to at least partially define a room.

In certain embodiments, individual wall panels and/or wall panel systems are provided wherein two or more wall panels are provided and are adapted to be joined or connected at a right angle. In preferred embodiments, the two or more walls panels are provided in an assembled state comprising a butt joint that is devoid of extensions or protrusions. U.S. Pat. No. 6,389,765 to Hautala, which is hereby incorporated by reference in its entirety, provides a corner joint for timber and logs. Hautala contemplates an interior corner that is flush, but comprises various joints and extensions that provide extensions and an irregular shape to the outer side of the constructed corner. Hautala fails to disclose various features, methods and devices of the present disclosure as shown and described herein.

U.S. Pat. No. 7,818,939 to Bearinger et al., which is hereby incorporated by reference in its entirety, discloses a snap lock joint for mating construction pieces. Bearinger et al., however, fail to provide various features and devices of the present disclosure including, for example, interlock features that provide flush corner members, and methods of providing the same.

This Summary is neither intended or should it be construed as being representative of the full extent and scope of the present invention. The present invention is set forth in various levels of detail and the Summary as well as in the attached drawings and in the detailed description of the invention and no limitation as to the scope of the present invention is intended by either the inclusion or non-inclusion of elements, components, etc. in the Summary. Additional aspects of the present invention will become more readily apparent from the detailed description, particularly when taken together with the drawings.

BRIEF DESCRIPTION OF THE FIGURES

The accompanying drawings which are incorporated herein and constitute a part of the specification, illustrate various embodiments of numerous inventions and together with the general description of the invention given provide the detailed description, and the drawings serve to explain the principles of these embodiments.

Figure 1:
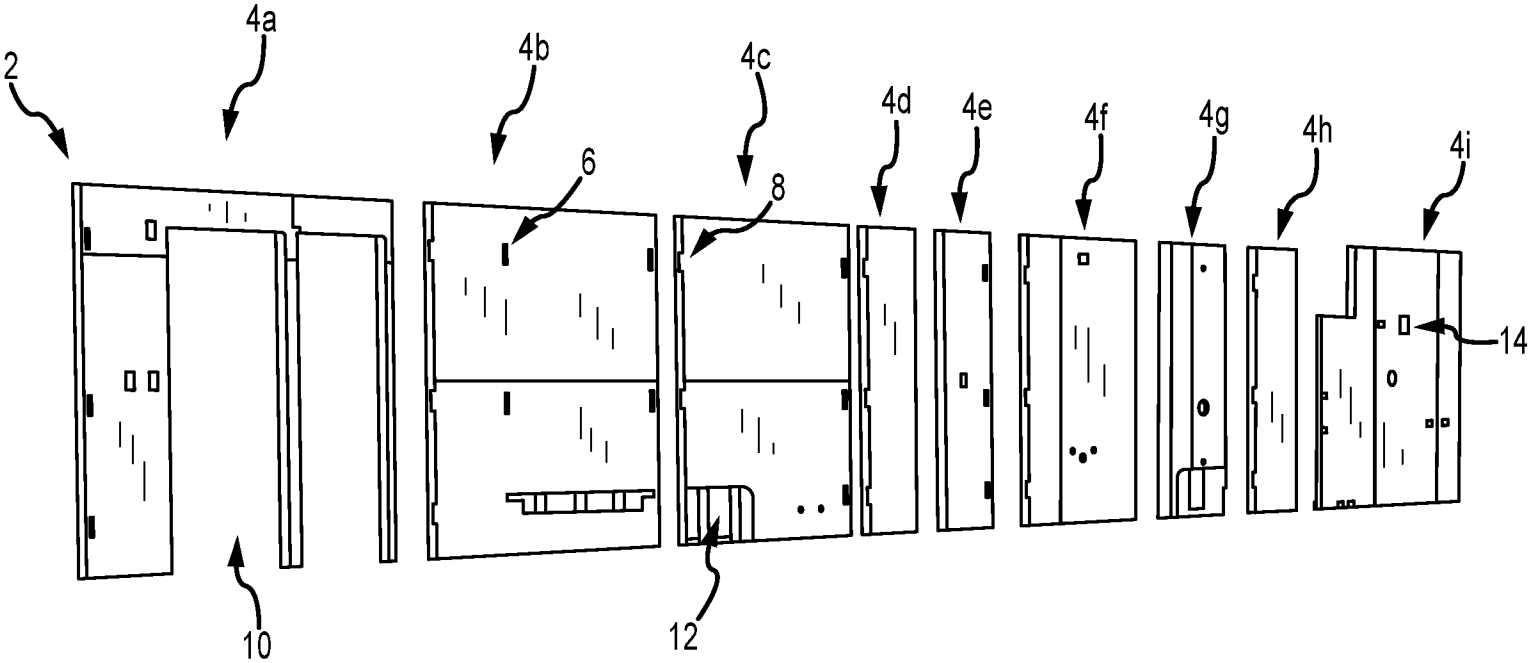
FIG. 1 is a perspective view of a plurality of wall panels according to one embodiment of the present disclosure.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The following is a listing of components according to various embodiments of the present disclosure, and as shown in the drawings:

The following is a listing of features and components of the various embodiments:

| Component # | Component |
|---|---|
| 2 | Wall panel system |
| 4 | Wall panel member |
| 6 | Female receiving port |
| 8 | Male extension |
| 10 | Doorway |
| 12 | Ducting aperture |
| 14 | Electrical aperture |
| 16 | Edge |
| 18 | Wall panel surface |
| 20 | Wall panel member |
| 22 | Wall panel member |
| 24 | Support member |
| 26 | Support member |

-continued

| Component # | Component |
|---|---|
| 28 | Male extension |
| 30 | Female aperture |

FIG. 1 is a perspective view of a wall panel system 2 according to one embodiment of the present disclosure. As shown, a plurality of wall panel members 4*a*, 4*b*, 4*c*, 4*d*, 4*e*, 4*f*, 4*g*, 4*h*, 4*i* are provided. The wall panel members 4 are provided in-line and spaced apart for illustration purposes. The wall panels are not provided in an assembly arrangement in FIG. 1. The wall panel members 4 of FIG. 1 comprise a plurality of different-sized wall panel members that are intended to be assembled in at least one specific arrangement to provide an enclosed building unit or "pod". The wall panel members 4 of FIG. 1 comprise various features including, for example, female receiving ports 6 and male extensions 8, wherein the female ports and male extensions 6, 8 are operable to be connected and enhance ease, efficiency, and accuracy of assembling the wall panel members 4 into a modular enclosure, room or pod. The wall panel members 4 further comprise various features including, for example, doorways 10, ducting apertures 12, and electrical apertures 14 for receiving and accommodating various additional building features as will be recognized by one of ordinary skill in the art.

Figure 2B:
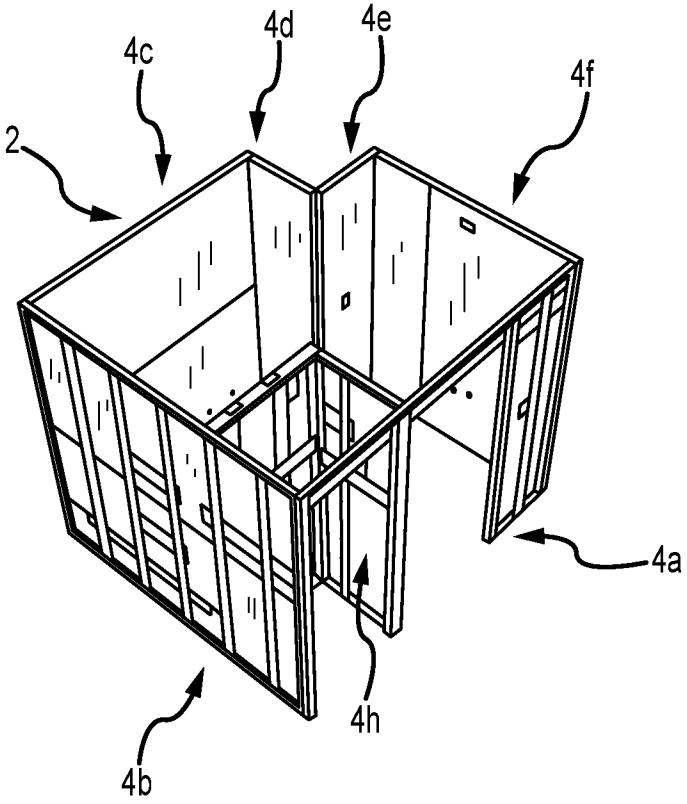
FIG. 2B is a perspective view of the plurality of wall panels according to the embodiment if FIG. 2A, and wherein the wall panels are assembled.
Figure 2A:
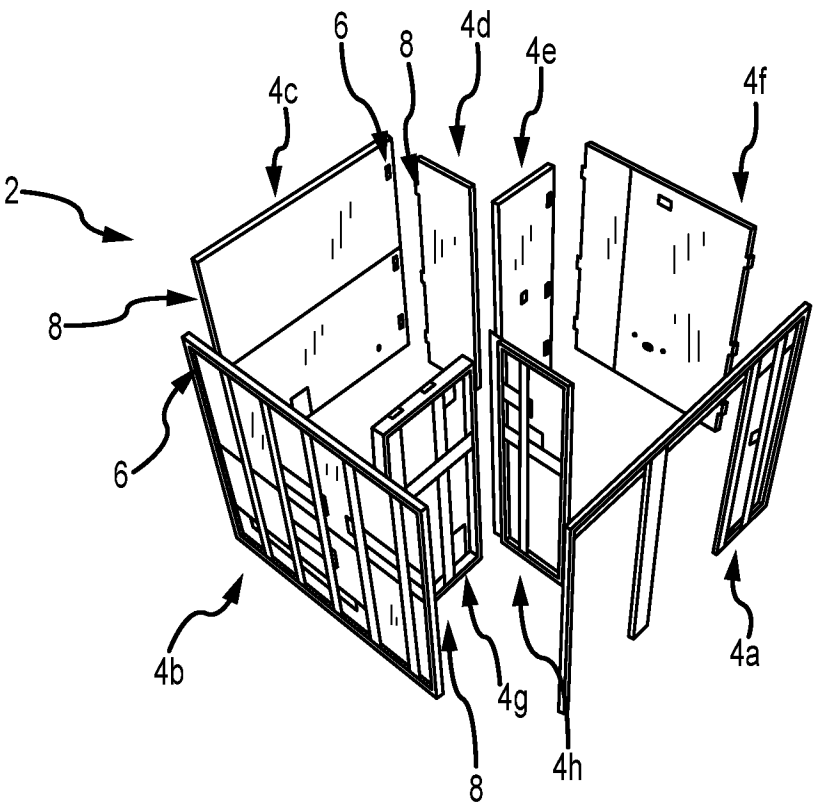
FIG. 2A is a perspective view of a plurality of wall panels according to one embodiment of the present disclosure, and wherein the wall panels are positioned for assembly.

FIG. 2A is a perspective view of the wall panel system 2 according to the embodiment of FIG. 1, wherein the wall panel members 4 are arranged and prepared for assembly. As shown in FIG. 2A, the wall panel system 2 comprises a plurality of wall panel members, and at least some of the wall panel members comprise female receiving ports 6 and at least some of the wall panel members 4 comprise male extensions 8 adapted to be received within the female receiving ports 6. In certain embodiments, each of the wall panel members 4 comprise at least one female receiving port 6 on a first end of the wall panel and at least one male extension 8 provided on a second end of the wall panel 4. In such embodiments, each wall panel member 4 comprises a first end operable to receive an adjacent wall panel member and a second end operable to be at least partially inserted into a second adjacent wall panel. In certain embodiments, wall panel members 4 are provided comprising a specific arrangement of female receiving ports 6 and male extensions 8 wherein the arrangement and spacing of the female receiving ports 6 and male extensions 8 only permit a specific assembled arrangement of the wall panels. For example, and referring now to FIG. 2A, it is contemplated that a first wall panel member 4*c* is to be connected to a second wall panel member 4*d* on one end, and to a third wall panel member 4*b* on a second end. To facilitate such an assembly, the first wall panel member 4*c* comprises an arrangement of female receiving ports 6 that correspond to and permit acceptance of the male extensions 8 provided on the second wall panel member 4*d*. Similarly, a second end of the first wall panel member 4*c* comprises an arrangement of male extensions 8 that are operable to be inserted into female receiving portions 6 provided on a third wall panel member 4*b*. Preferably, the first end of the first wall panel member 4*c* is capable of receiving the male extensions of the second wall panel member 4*d*, but not the male extensions 8 provided on the third wall panel member. In such embodiments, a wall panel system 2 may only be assembled in a predetermined orientation (for example, a first wall panel 4*c* can only receive a second wall panel 4*d* on a first end and can only receive a third wall panel 4*b* on a second end). It is further contemplated that wall panels 4 of the present disclosure may comprise labelling or indicia to indicate which wall panels should be connected at specific locations.

FIG. 2B is a perspective view of the system 2 according to the embodiment of FIG. 2A, and wherein the wall panel system 2 has been assembled. In FIG. 2B, each of the wall panels 4 have been interconnected to form a completed modular unit or pod. The assembly may comprise, for example, a modular bathroom pod that is operable to be inserted into a larger building or construction project. The male extension members 8 and female receiving portions 6 shown and described herein are contemplated as comprising guide members, wherein the male extension members 8 and female receiving portions 6 help guide and align an assembly process. The male extension members 8 and female receiving portions 6 are also contemplated as providing some structural stability or support for connecting adjacent wall panel members 4. In certain embodiments, adjacent wall panels 4 are further secured or interconnected using additional connecting means. Such connecting means include, but are not limited to, known fasteners and connectors for securing wall panels. Such fasteners and connectors include bolts, rivets, adhesives, screws, welds, etc.

Figure 3:
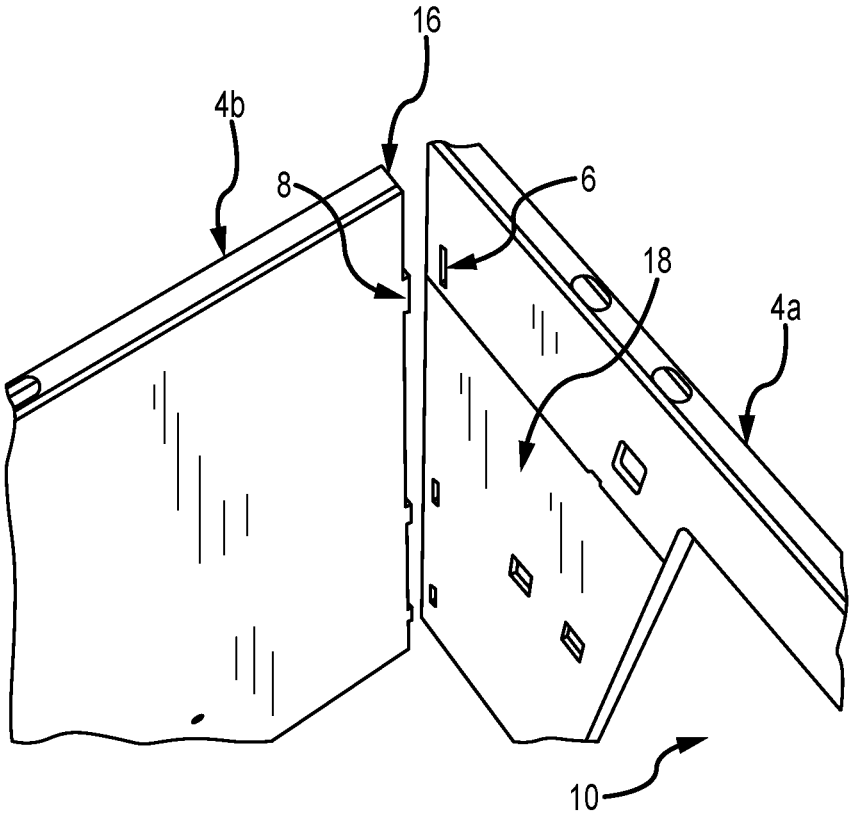
FIG. 3 is a detailed perspective view of a first and second wall panel according to one embodiment of the present disclosure.

FIG. 3 is a detailed perspective view of adjacent wall panel members 4*a*, 4*b* readied for interconnection. As shown, a first end of a first wall panel member 4*a* comprises a plurality of female receiving portions 6. A second end of a second wall panel member 4*b* comprises a plurality of male extension members 8. The male extension members 8 of the second wall panel member 4*b* are spaced and distributed in an arrangement that corresponds to a spacing and arrangement of the plurality of female receiving portions 6 of the first wall panel member 4*a*. The male extension members 8 also preferably comprise coplanar and/or flush extensions of the wall panel 4*b*, wherein an interior wall surface is flush or coplanar with a surface of the male extensions.

Figure 4:
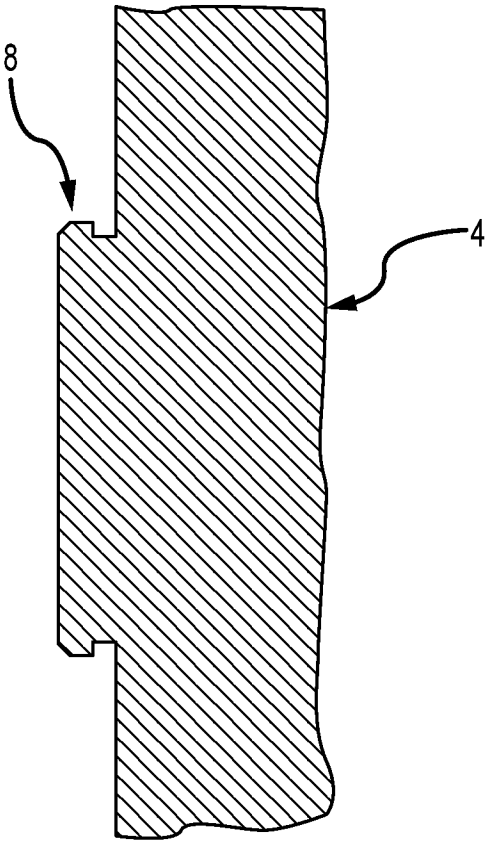
FIG. 4 is a dimensioned drawing of a wall panel according to one embodiment of the present disclosure.

FIG. 4 is a dimensioned drawing of a wall panel 4 and a male extension 8 according to one embodiment of the present disclosure. Various dimensions are provided in FIG. 4, but it will be recognized that the present disclosure and embodiments of the present disclosure are not limited to the dimensions or proportions provided in FIG. 4. The illustrated dimensions are provided to illustrate one embodiment of the present disclosure. Various modifications are contemplated. As shown in FIG. 4, the wall panel 4 comprises a male extension 8 extending from the wall panel. The male extension 8 comprises radii to the corners of the extension 8 to facilitate assembly of wall panels and insertion of the male extension 8 into female receiving portions (see FIG. 5, for example).

Figure 5:
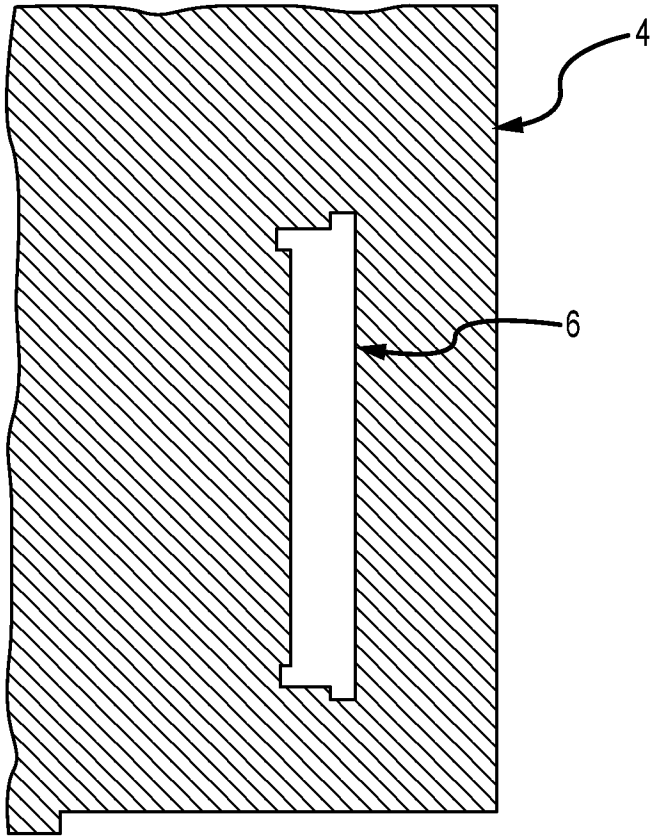
FIG. 5 is a dimensioned drawing of a wall panel according to one embodiment of the present disclosure.

FIG. 5 is a dimensioned drawing of a wall panel 4 and a female receiving portion 6 extension according to one embodiment of the present disclosure. Various dimensions are provided in FIG. 5, but it will be recognized that the present disclosure and embodiments of the present disclosure are not limited to the dimensions or proportions provided in FIG. 5. The illustrated dimensions are provided to illustrate one embodiment of the present disclosure. Various modifications are contemplated. As shown in FIG. 5, the wall panel 4 comprises a female receiving portion 6 with the illustrated shape, dimensions and proportions.

The wall panel members 4*a*, 4*b* of FIG. 3 are provided as adjacent and perpendicular wall panel members, wherein the male extensions 8 of the second wall panel member 4*b* extend from an end 16 of the wall panel member 4*b*. The female receiving portions 6 of the first wall panel member 4*a* are provided flush with a surface 18 of the wall panel member 4*a*. The features of wall panel members 4 as shown and described herein provide for quick and simple assembly of a modular building unit by enabling and facilitating vertical and horizontal alignment of wall panels. The arrangement of male and female members also allows for clean interior corners and, in at least some embodiments, clean outer corners wherein an interior corner and an exterior corner comprise flush perpendicular surfaces substantially devoid of extensions, overhangs, etc.

Figure 6:
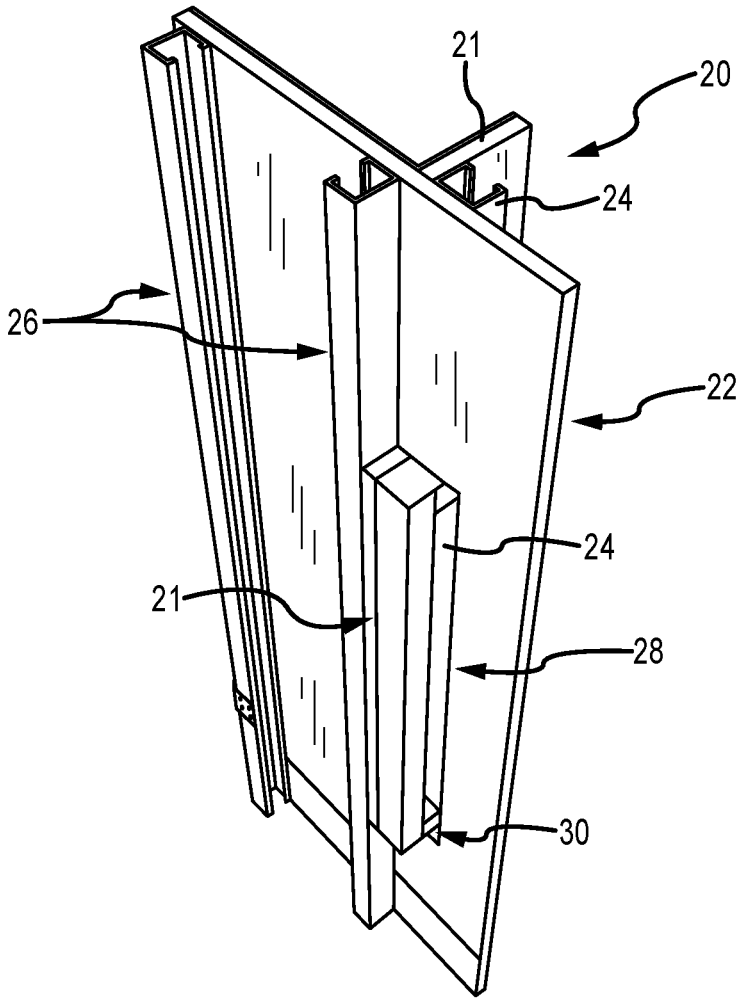
FIG. 6 is a perspective view of a plurality of wall panels according to one embodiment of the present disclosure

FIG. 6 is a perspective view of a system according to one embodiment of the present disclosure. As shown, a first wall panel member 20 and a second wall panel member 22 are provided. The wall panel members 20, 22 comprise interlocking members. The members 20, 22 may comprise wall panels of various dimensions, including various lengths, widths and heights. The members 20, 22 provided in FIG. 6 are truncated for illustrative purposes, and no limitation with respect to the dimensions of the members is provided.

The first wall panel member 20 comprises a male extension 28 that is operable to extend through a female aperture 30 provided in the second wall panel member 22. The first wall panel member 20 comprises a first portion 21 and a second portion 24. The first portion 21 preferably comprises a wall surface member such as gypsum. The second portion 24 comprises a preferably rigid structural member such as a metal or wood stud or frame member. The first wall panel member 20 is formed or shaped such that at least a portion of the first portion 21 and the second portion 24 are provided as the male extension 28.

Figure 8:
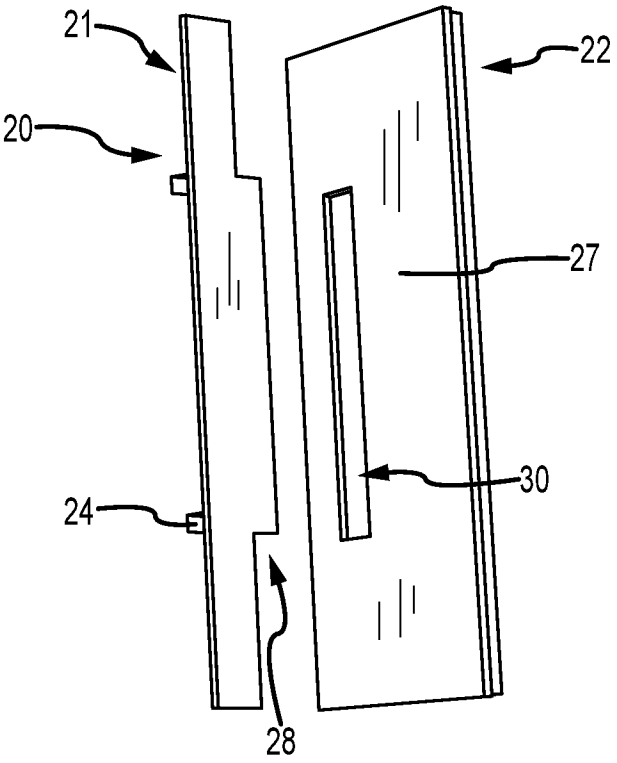
FIG. 8 is an exploded perspective view of the plurality of wall panels according to the embodiment of FIG. 6.
Figure 7:
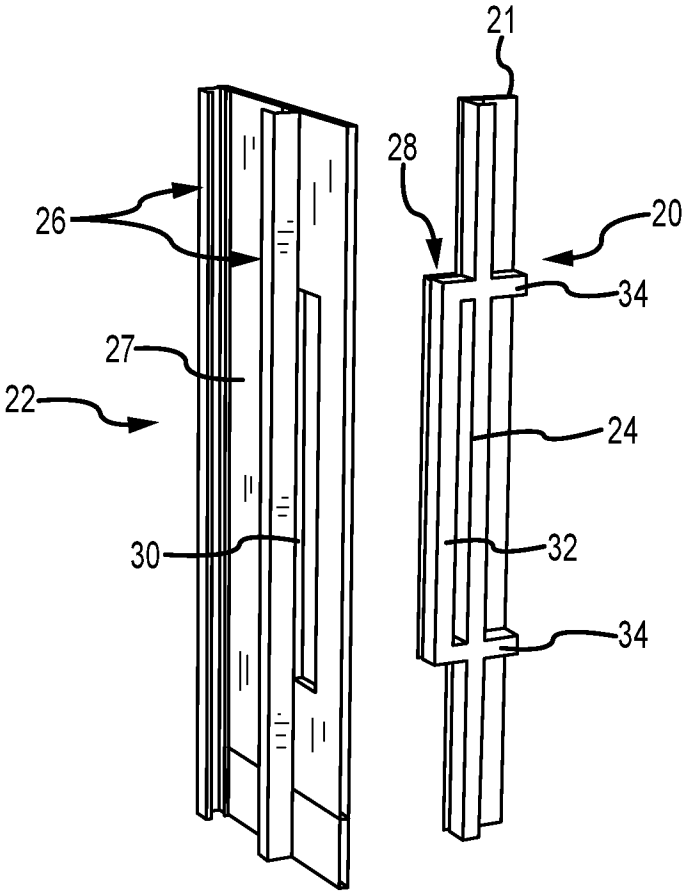
FIG. 7 is an exploded perspective view of the plurality of wall panels according to the embodiment of FIG. 6.

FIGS. 7-8 are exploded perspective views of the wall panel members 20, 22 according to the embodiment of FIG. 6. FIG. 8 comprises a view that is rotated by approximately 180 degrees about a substantially vertical axis from FIG. 7. FIG. 7 illustrates the first wall panel member 20, including a first portion 21 and a second portion 24 wherein the second portion 24 comprises a support member. In the embodiment of FIG. 7, the second portion 24 comprises a metal support member. The second portion 24 may comprise, for example, extruded aluminum or steel. A second wall panel member 22 is provided comprising a support member 26, a wall surface 27, and a female aperture 30. The male extension 28 of the first wall panel member 20 is sized and operable to extend into the female aperture 30. In some embodiments, the first portion 21 of the first wall panel member 20 comprises dimensions that are slightly larger than the second portion 24 at least in the area of the male extension 28. The first portion 21 may be cut or trimmed either before or during insertion of the first wall panel member 20 into the second wall panel member 22. For example, the first portion 21 may be provided as a gypsum or sheet-rock member that is easily shaped prior to assembly or during assembly.

As shown in FIG. 7, the male extension 28 comprises at least one vertical member 32 and a pair of horizontal members 34 extending perpendicularly thereto. The vertical member 32 and at least a portion of each of the horizontal members are operable to be inserted to the female receiving portion 30 of the second wall panel member 22. The horizontal members 34 may be joined to, welded to, or co-formed with the support member 24 as shown in FIG. 7. However, as the horizontal members 34 and the male extension 28 are not intended to be load-bearing support features and are instead intended to guide and support assembly of multiple wall panels, a connection of the vertical member 32 and/or horizontal member 34 to the support member 24 and/or wall panel 20 may comprise various means and methods of construction.

The male extension 28 and female receiving member 30 of the embodiment provided in FIG. 7 are provided as rectilinear members. It will be recognized, however, that various alternatives shapes and orientations may be provided without deviating from the scope and sprit of the inventions disclosed herein.

Figure 9:
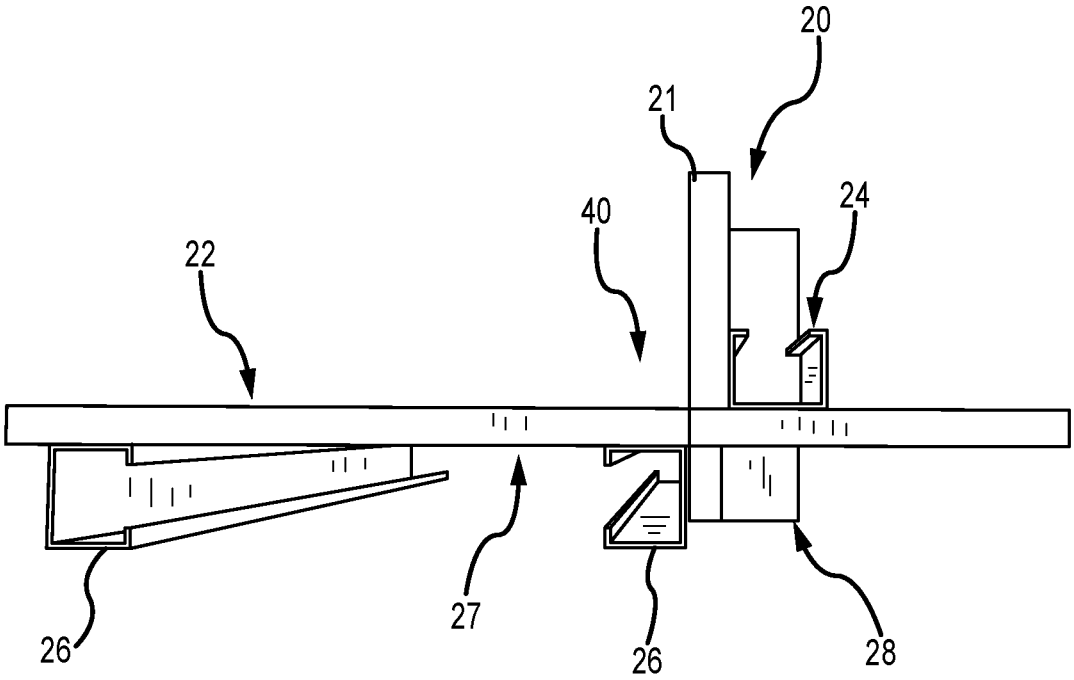
FIG. 9 is a top plan view of the plurality of wall panels according to the embodiment of FIG. 6.

FIG. 9 is a top plan view of the system according to the embodiment of FIG. 6. As shown in FIG. 9, a first wall panel member 20 and a second wall panel member 22 are provided. The first wall panel member 20 comprises a male extension 28 that extends through a portion of the second wall panel member 22. Each of the wall panel members comprise support elements 24, 26, such as studs or metal framing. In the arrangement shown in FIG. 9, the first wall panel member 20 and the second wall panel member 22 are joined together to form an interior corner 40. The interior corner 40 comprises a substantially perpendicular union of the two wall panel members and is operable to be provided as a corner to at least partially define a room or other structure. The structural support members 24, 26 are provided on exterior surfaces of the wall panel members with respect to the interior corner portion 40.

In certain embodiments, wall panel members and associated features as shown and described herein eliminate a need to "mud" corners of a building module. Existing devices and methods for forming an interior corner of drywall construction typically comprise the steps of taping and "mudding" (i.e. applying a wet drywall joint compound and allowing it to dry). Such methods are known to significantly increase the amount of time required to a complete or finish an interior corner, largely due to the time required to allow a wet compound to dry. Wait times for such drying operations may increase assembly or construction schedules by days. Such delays may be acceptable when dealing with a non-modular structure, and wherein other functions and work may be performed while drying occurs. In the modular building arts, however, such delays generally serve to slow a manufacturing process and reduce the number of modular units that can be assembled and shipped in a given time period. Embodiments of the present disclosure provide systems and methods that enable quick, efficient, and clean assembly of interior corner portions without the need to mud the interior corners, thereby greatly enhancing overall manufacturing efficiency.

It is contemplated that wall panel members 4 of the present disclosure are formed from and/or comprise various different materials suitable for use in building modules and wall panels. In certain embodiments, it is contemplated that the wall panel members 4 comprise gypsum. In various embodiments, wall panel members are contemplated as comprising various different thicknesses including but not limited to 0.5 inch and 0.625 inch thick wall panel members.

While the present invention has been illustrated by description of preferred embodiments and while the illustrative versions have been described in considerable detail, it is not the intention of the inventors to restrict or in any way limit the scope of the appended claims to such detail. Additional advantages and modifications will readily appear to those skilled in the art upon reading this detailed description. Therefore, the invention, in its broader aspects, is not limited to these specific details, respective apparatus and methods, and illustrative examples shown and described. Accordingly, departures may be made from such details without departing from the spirit or scope of the inventor's general inventive concepts.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of forming a modular building unit, comprising:

providing a plurality of pre-formed wall panels operable to be interconnected;

wherein a first pre-formed wall panel of the plurality of pre-formed wall panels comprises a first end and a second end and a planar surface extending between the first end and the second end;

the planar surface of the first pre-formed wall panel comprising a plurality of female receiving members comprising a predetermined distribution along the planar surface;

the first pre-formed wall panel comprising a plurality of metal studs on an opposing side of the first pre-formed wall panel from the planar surface and wherein at least one of the plurality of female receiving members is provided adjacent to a metal stud of the first pre-formed wall panel;

a second pre-formed wall panel of the plurality of pre-formed wall panels comprising a first end and a second end and a planar surface extending between the first end and the second end, the first end of the second pre-formed wall panel comprising a plurality of male extensions, the male extensions being sized and operable to be received within the plurality of female receiving members, and wherein the male extensions comprise substantially the same predetermined distribution as the female receiving members;

providing a plurality of support elements on the first second preformed wall panel, wherein each of the plurality of support elements comprises a metal stud provided on an opposing side of the second preformed wall panel from the planar surface of the second preformed wall panel;

wherein at least one of the plurality of male extensions comprises a rectilinear member having at least one vertical member and a pair of horizontal members, and wherein the at least one of the plurality of male extensions members is joined to or co-formed with at least one metal stud of the second pre-formed wall panel and wherein the pair of horizontal members are connected to the at least one metal stud;

inserting the plurality of male extensions of the second pre-formed wall panel into the plurality of female receiving members in the first pre-formed wall panel to secure the first pre-formed wall panel and the second pre-formed wall panel to form at least one of an interior corner and an exterior corner; and wherein the method is devoid of taping and mudding the first pre-formed wall panel and the second pre-formed wall panel.

2. The method of claim 1, wherein the plurality of pre-formed wall panels are at least partially comprised of a gypsum material.

3. The method of claim 1, wherein at least one of the plurality of female receiving members and at least one of the plurality of male extensions are formed with an accuracy of plus-or-minus 0.001 inches relative to a desired dimension.

4. The method of claim 1, wherein at least one of the plurality of pre-formed wall panels comprises a thickness of between 0.5 inches and 0.625 inches.

5. A method of forming a modular building unit, the method comprising:

providing a first wall panel member comprising a first portion and a second portion;

wherein the first portion of the first wall panel member comprises a wall surface member, and wherein the second portion of the first wall panel member comprises a first metal stud;

providing a second wall panel member comprising a plurality of metal studs on a first side and a planar surface on a second, opposing side;

forming a plurality of apertures in the second wall panel member, wherein the plurality of apertures are formed using a computer-numeric controlled process and wherein at least one of the apertures is provided adjacent to one of the plurality of metal studs;

forming an extension on the first portion of the first wall panel member, wherein the extension is formed using a computer-numeric controlled process and wherein at least a portion of the extension is provided co-planar with a surface of the first portion;

wherein the second portion of the first wall panel member comprises a rectilinear member having at least one vertical member and a pair of horizontal members, and wherein the extension is joined to or co-formed with the first metal stud;

securing the first portion of the first wall panel member to the second portion of the first wall panel member; and inserting the rectilinear member into an aperture of the plurality of apertures in the second wall panel member to secure the first wall panel member and the second wall panel member and at least partially define an interior volume of a room.

6. The method of claim 5, wherein the first and second wall panel members are provided and secured at a perpendicular angle to one another.

7. The method of claim 5, wherein the method is devoid of taping and mudding the first and second wall panel members.

8. The method of claim 5, wherein the first portion of the first wall panel member comprises gypsum.

9. The method of claim 5, wherein the rectilinear member is joined to or conformed with the rigid structural member.

10. The method of claim 5, wherein the first portion of the first wall panel member comprises a thickness of between 0.5 inches and 0.625 inches.

* * * * *